US006413374B1

(12) United States Patent
Laurikainen et al.

(10) Patent No.: US 6,413,374 B1
(45) Date of Patent: Jul. 2, 2002

(54) THREADING DEVICE AND METHOD FOR THREADING THE TAIL OF THE WEB

(75) Inventors: Mauri Laurikainen, Varkaus; Pauli Kytönen, Tuusula; Harri Kuosa; Pekka Koivukunnas, both of Järvenpää; Markku Kyytsönen, Numminen; Jorma Kinnunen; Vesa Ahvenniemi, both of Helsinki, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/554,353

(22) PCT Filed: Nov. 13, 1998

(86) PCT No.: PCT/FI98/00889

§ 371 (c)(1),
(2), (4) Date: May 12, 2000

(87) PCT Pub. No.: WO99/25920

PCT Pub. Date: Feb. 27, 1999

(30) Foreign Application Priority Data

Nov. 14, 1997 (FI) ..... 974231
Mar. 11, 1998 (FI) ..... 980543

(51) Int. Cl.[7] ..... D21F 1/36

(52) U.S. Cl. ..... 162/193; 162/194; 162/289; 162/361; 162/372; 162/286; 162/255; 242/56.6; 242/56 R; 242/56.3; 242/56.4; 83/98; 83/102

(58) Field of Search ..... 162/193, 194, 162/289, 361, 372, 286, 255; 242/56.6, 56 R, 56.3, 56.4; 83/98, 102

(56) References Cited

U.S. PATENT DOCUMENTS 3,705,676 A 12/1972 Overly et al. ..... 226/97
3,764,085 A * 10/1973 Hawkins ..... 242/56.6
4,022,366 A 5/1977 Rooney ..... 226/91
4,209,362 A 6/1980 Salmela et al. ..... 162/264
4,501,643 A 2/1985 Kiuru ..... 162/286
5,456,802 A 10/1995 Worcester ..... 162/289

FOREIGN PATENT DOCUMENTS

| | | |
|---|---|---|
| DE | 1253570 | 11/1967 |
| DE | 3924897 | 2/1991 |
| EP | 0232689 | 11/1986 |
| FI | 89288 | 5/1993 |
| GB | 1530874 | 11/1978 |

* cited by examiner

*Primary Examiner*—Stanley S. Silverman
*Assistant Examiner*—Mark Halpern
(74) *Attorney, Agent, or Firm*—Steinberg & Raskin, P.C.

(57) ABSTRACT

A threading device and a method for threading a tail of a web, wherein, for guiding the path of a tail separated from a full-width web in a paper machine or a paper finishing device, the threading device comprises a suction channel, placed at least partly in a paper machine portion and provided with a reduced pressure for gripping the tail, and transfer means for transferring the suction channel in the portion of the paper machine and simultaneously for releasing the tail to the portion. In the method for threading of the tail, before threading the full-width web through a portion in a paper machine, the tail is separated from the web, the tail is cut, and the tail is conveyed in the portion of the paper machine, after which the full-width web following the tail in a continuous manner is conveyed to the portion, by providing a reduced pressure in a suction channel, by transferring an inlet opening of the suction channel close to the tail separated from the web, by transferring the tail into the suction channel by means of the reduced pressure prevailing therein, and by releasing the tail to the portion of the paper machine by transferring the suction channel and particularly the inlet opening in the direction of the portion of the paper machine.

31 Claims, 8 Drawing Sheets

THREADING DEVICE AND METHOD FOR THREADING THE TAIL OF THE WEB

FIELD OF THE INVENTION

The invention relates to a threading device for guiding the path of a tail separated from a full-width web along a portion of a paper machine or a paper finishing device, and a method for threading the tail of the web. Below in this description, the tail of the web can also be referred to with the shorter expression "tail".

BACKGROUND OF THE INVENTION

For guiding the web along a portion of the paper machine, in other words between two or more sections in the paper machine, such as the drying section and the calender section, a narrow strip, the so-called tail, is separated from the full-width web, to be transferred along the portion before guiding the full-width web to the portion. The purpose of this is to secure the controlled, faultless run of the tail and further the whole web, wherein first after the tail has passed the portion without problems, a substantially wider part to follow the tail is separated from the web by cutting and is further widened to guide the full-width web following the tail to the portion.

Before threading, the web usually runs freely down e.g. to a pulper or the like placed underneath the last drying cylinder in the drying section, wherein a relatively heavy portion of the web, extending several meters, can be in a state uncontrolled as such, which further complicates the controlled threading. Problems occur particularly at the stage of starting to move the tail from the uncontrolled, downwards running movement to run in a controlled manner e.g. between cylinders in a calender.

Known solutions for guiding the tail are primarily based on the use of air jets in connection with various conveyor troughs and guide plates. The use of air jets as such easily develops a phenomenon that when the tail meets a nip between rolls in the next section it has a fold in the transverse direction and/or it is in an otherwise random position in its transverse direction, which may cause wrinkling of the tail, thereby slowing down the progressive movement of the tail. This phenomenon makes it difficult to guide the tail into the nip and between the cylinders, and may even cause damage in parts of the paper machine. In several known solutions, this is due to the fact that breaking off of the tail cannot be influenced to a sufficient degree, but the breaking off takes place at random as such and often first after a considerable portion of the tail has already been moved into the nip or between cylinders or the like.

In threading of the paper web through calenders, it has been common to use rope threading systems in which the tail is guided between threading ropes arranged at the ends of rolls. At the same time, the tail must be pulled aside from the actual running path of the paper web.

The rope systems involve known drawbacks, such as the space required by them in the cross direction of the machine and the said pulling to the side, which may be a problem with weak paper grades. Furthermore, high web running speeds impose requirements on the functional reliability of the rope system.

Finnish patent 52478 discloses a solution for cutting the tail before moving the tail to the portion of the paper machine. The solution is based on a chopper arranged to operate in a way that it chops the web into pieces before it ends up in a pulper or the like, whereby the tail is left intact only on the length which is needed for guiding the tail by using air jets or the like. In this way, it is possible to provide the web with a short and light-weight portion of the tail connected thereto, which can be moved to the run in a controlled manner. This solution also prevents the tail from being double-folded when it enters a nip or the interspace between cylinders. However, the apparatus according to this solution is complex, and its blades increase occupational safety risks.

Finnish patent 62695 discloses a solution based on planar guide plates. The guide plates are arranged at a certain angle to each other in a way that the direction of the first plate corresponds to the direction of guiding the cut tail end further, and the direction of the second plate corresponds to the direction of guiding the tail into a pulper or the like. The guide plates are arranged to co-operate with air jets provided in connection with the same, to act as guide and conveying surfaces so that when the air jets draw the tail into opposite directions, the tail is cut by breaking between the plates, and the cut end of the tail is guided by the action of the air jets into the nip. The end running into the pulper is blown into the vicinity of the guide plates and the air jets by a separate air jet. A drawback in the described solution is the relatively large number of air jets, the great need of pressurized air, and the noise caused by the jets, as well as the unnecessary and disturbing air flows produced in their vicinity. The solution is reliable as such, but for example external air flows may cause disturbances in it. Furthermore, the tail must be bent onto a wide curve during the guiding, whereby it may be folded or turned away from its correct position.

Furthermore, the use of air guides for guiding the tail on the length of a certain portion from the drying section to a rope gap formed by threading ropes is disclosed e.g. in Finnish patent 89288 and in German application publication 3924897. However, all of the solutions described above have the drawback that, particularly in the beginning of the run, the tail is, in spite of cutting, still in a relatively uncontrolled state. The above-mentioned problems related to guiding of the tail to the run cannot thus be fully eliminated.

As a mechanical solution, a suction transfer mat or a suction belt is used, which is a continuous loop-like structure arranged to run through two rolls or the like located at a distance from each other. The purpose of the tail is to run along with the upper surface of a revolving mat, for which purpose the upper surface of the mat is provided with a suction through the mat. The use of the suction transfer mat usually requires several successive suction transfer mat units to span one portion of the paper machine, each unit requiring a separate power arrangement with an electric motor or the like driving system with associated power transmission, and further at least one suction device and mat-specific arrangements for directing a vacuum onto the surface of the mat. The tail is usually brought onto the first suction transfer mat with an air jet, and the transfer of the tail further from one mat to another requires separate arrangements, whereby the structure as a whole becomes rather complex and expensive and it does not very easily provide a continuous, fully controlled tail threading. Such arrangements are presented e.g. in European patent 232689 and in Swedish published specification 420431.

OBJECTS AND SUMMARY OF THE INVENTION

It is the purpose of the invention to eliminate the above-mentioned drawbacks and to improve the prior art by presenting a threading device and a method for threading the tail of the web, wherein the tail can be conveyed over the whole portion of the paper machine in a controlled manner and wherein even very long threading lengths can be accomplished. For achieving this aim, the threading device according to the invention is primarily characterized in what will be presented in the characterizing part of the independent claim 1. The device comprises a suction channel provided with reduced pressure for gripping the tail, movable in the portion of the paper machine, and transfer means for transferring the suction channel in the portion of the paper machine and also for releasing the tail along the portion. The method for threading the tail of the web is characterized in what will be presented in the characterizing part of the independent claim 17. In the method, the inlet opening of the suction channel provided with reduced air pressure is first moved close to the tail, after which the tail is moved into the suction channel by means of the reduced pressure prevailing therein and the tail is released along the portion by moving the suction channel.

Transfer tubes are prior known in connection with a paper machine only as fixed systems for removing extra edge strips to be cut off the web. These solutions, which are not related to threading and the problems involved therein, are presented e.g. in Finnish patent 62155 and in German published specification 1253570.

The threading device according to the invention has several advantages, the most essential to be mentioned being that the tail can, in a controlled manner, be taken to be transferred by the device, directly at the beginning of a portion of the paper machine or paper finishing device, for example immediately after the last drying cylinder in the drying section. Thus, the tail is at no stage left exposed to the effect of e.g. external air flows or machine parts. In a preferred embodiment, the device comprises also a cutting means for cutting the tail before starting its transfer to the portion, wherein a transverse fold in the tail is avoided. The device requires considerably smaller air flows than in the known solutions, which contributes to the reliability of the device and reduces e.g. noise problems. Furthermore, it is obvious that the relative simplicity of the structure makes the device advantageous also in view of e.g. maintenance operations. As a considerable advantage, it should also be mentioned that the device and the method can be applied in a flexible manner at different web running speeds and for different grades and strengths of paper to be manufactured.

By means of the invention, the tail of the web can be placed in a controlled manner onto the path determined by the web geometry even at high web running speeds and also in complex web running geometries.

Other features characteristic to the threading device and to the method for threading the tail of the web according to the invention will be disclosed in the appended dependent claims.

BRIEF DESCRIPTION OF THE DRAWINGS

In the following description, the invention will be illustrated in more detail with reference to the appended drawings, in which.

DETAILED DESCRIPTION OF THE PREFERRED EMBODIMENTS

Figure 1:
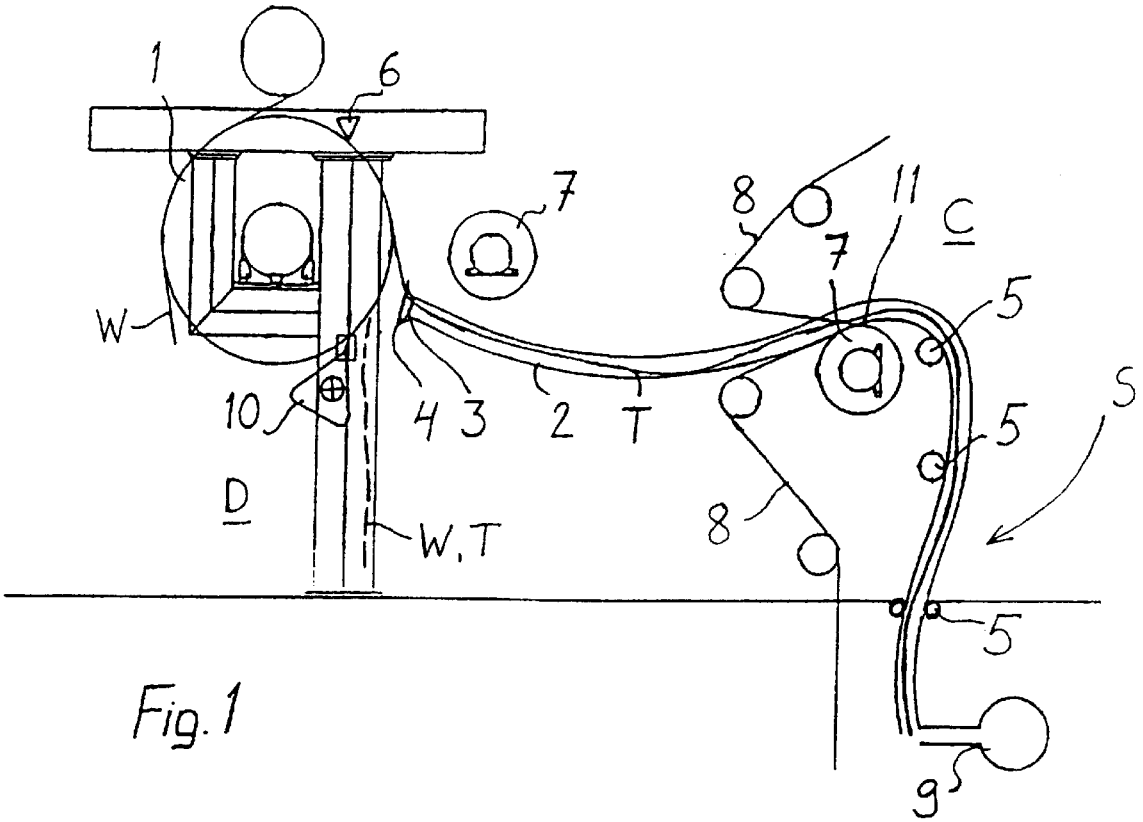
FIG. 1 shows an embodiment of the invention before threading, seen from the side.
Figure 2:
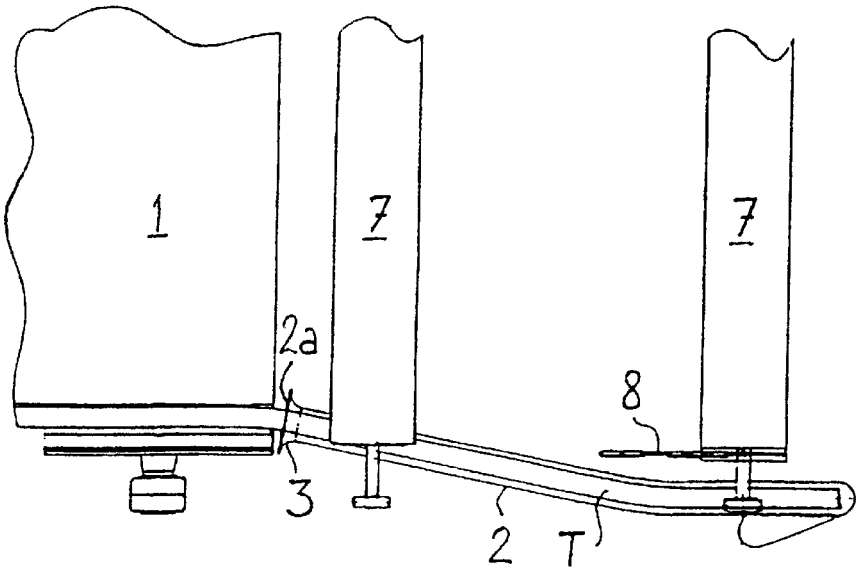
FIG. 2 shows the embodiment of FIG. 1, seen from above.
Figure 3:
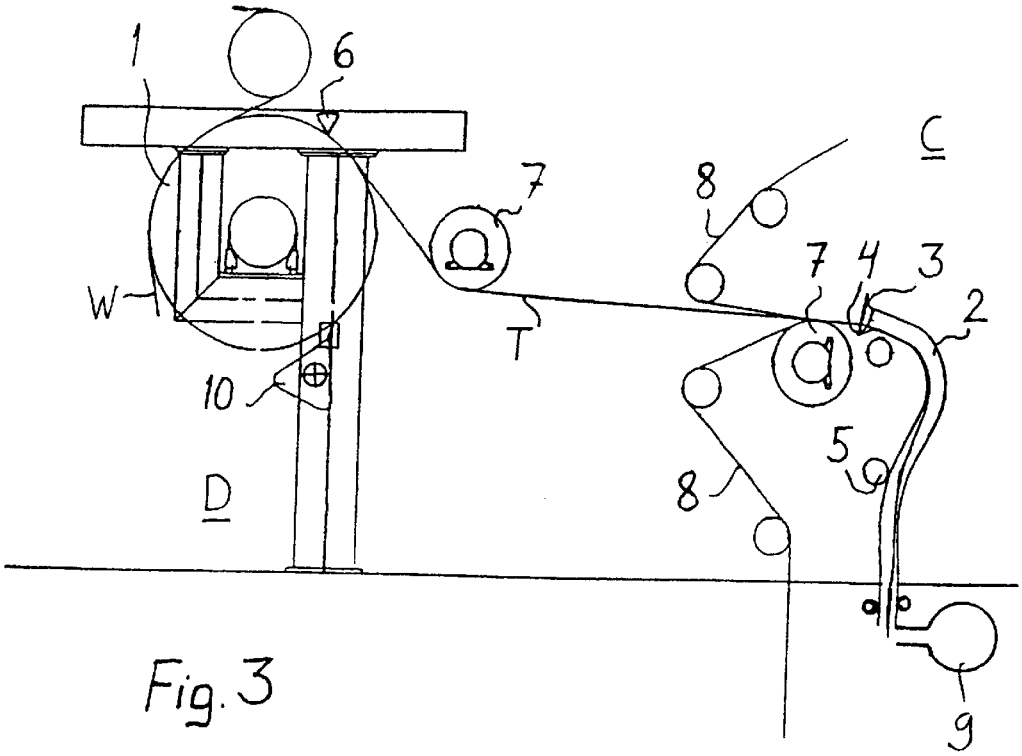
FIG. 3 shows the embodiment of FIG. 1 after threading, seen from the side.
Figure 4:
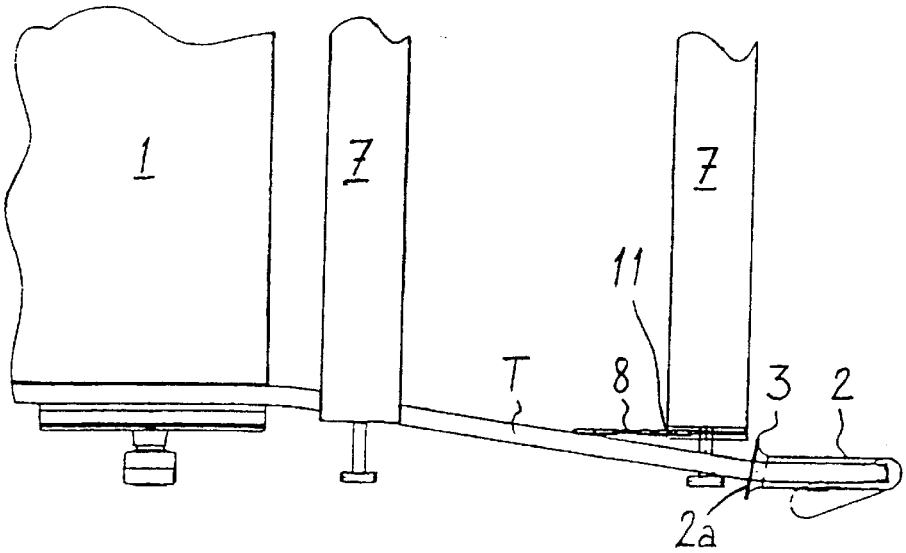
FIG. 4 shows the situation of FIG. 3 as seen from above.

The embodiment of FIGS. 1 and 2 shows schematically the threading device before threading over a paper machine portion which comprises the distance from the last cylinder 1 in a drying section D to the next processing section in the paper machine, such as a calender section C or the like. The threading device consists of a suction channel 2, transfer means S for transferring the suction channel 2 in the running direction of a tail T for the purpose of releasing the tail T along the paper machine portion, and a suction device 9, known as such, for developing a negative pressure in the suction channel 2. The suction channel 2 is a flexible, tubular means with a closed cross section, such as a plastic or rubber hose or the like.

The suction channel 2 comprises, at the end of its inlet opening, a mouth piece 3 connected to the suction channel 2 as a direct extension thereof. According to the embodiment of the figure, this mouth piece 3 is a substantially funnel-shaped structure which tapers from the inlet 2*a* in the direction of the suction channel 2 and serves the purpose of facilitating the entry of the tail T in the suction channel 2.

The transfer means S comprise at least one, preferably several transfer rolls 5, to support the suction channel 2 during the transfer. In the figure, the transfer rolls 5 are special rolls intended for guiding the suction channel 2, but in some portions, at least some of them can consist of rolls and/or cylinders conveying the web W, depending in each case on the most expedient path of the suction channel 2 in relation to the path of the web W. Furthermore, the transfer means S comprise a power unit, known as such (not shown in the figures). It is obvious that the transfer rolls 5 can be partly or wholly replaced by transfer carriages, transfer troughs or other corresponding structures.

According to this preferred embodiment, the cutting means 4 for cutting the tail T is provided by making the outermost edge of the mouth piece 3, preferably at least its lower part, sharp, wherein in the initial situation, the tail T running down is cut through when it is transferred into the suction channel 2. For the operation of the cutting means 4, it is advantageous in the described arrangement that the mouth piece 3 is at least partly made of a metal or a corresponding material, wherein it is possible to provide and maintain a sharp edge. It is obvious that the cutting means 4 can also be any other, even separate cutting means, known as such, which is placed near the mouth piece 3 or is fixed to the same, wherein it can be e.g. a moving cutting blade or the like.

The threading device according to the presented embodiment is further provided with at least one guide roll 7 or the like for guiding the tail T at the stage when some of the tail T has been released from the suction channel 2 to the paper machine section.

For manipulating the part of the suction channel 2 which accumulates at the end of the portion after releasing of the tail T, the device is further provided with an arrangement, known as such, for folding, winding or controlling the suction channel 2 in another corresponding manner. Such arrangements are not shown in more detail in FIGS. 1 to 4.

Before the situation of FIGS. 1 and 2, the web W and the tail T, separated from the edge of the web W by a cutter 6 or the like and having usually a width of ca. 15 to 50 cm, run, under the guidance of a doctor 10, down to a pulper or the like, and this run is indicated with a broken like. In the suction channel 2, a negative pressure is developed with a suction device 9, and the suction channel 2 is transferred so that its mouth piece 3 is placed sufficiently close to the part of the tail T running to the pulper or the like so that by the effect of the negative pressure in the suction channel 2, the tail T is sucked into the suction channel 2 and the tail T is simultaneously cut through when it hits the cutting means 4. The cutting means is thus preferably a part of the mouth piece 3, such as a sharpened edge of the mouth piece 3 or a separate cutting blade which is fixed on the mouth piece and which can be movable. In the application in which the cutting means 4 is a movable cutting blade or the like separate from the mouth piece, the tail T is cut in a way known as such and required by said application. The tail T is sucked by means of the negative pressure in the channel to run through the suction channel 2. In this way the tail T can be made sufficiently tight to be released to the paper machine portion. The part of the tail T passed through the suction channel 2 is guided into the pulper or a corresponding after-treatment device.

For conveying and releasing the tail T to the paper machine portion (FIGS. 3 and 4), the suction channel 2 is moved substantially in the direction of the threading towards a calender section C or the like simultaneously when the negative pressure effective in the suction channel draws the tail T coming at the running speed continuously into the suction channel and keeps the tail T tight. When the outermost end of the suction channel 2, i.e. the inlet opening 2*a*, is moved in the machine direction in the paper machine portion, the tail T is released onto a path passed by the inlet opening. To bring the tail T in the correct position into a rope nip 11 formed by threading ropes 8 or the like at the end of the guide roll 7 of the calender section, the suction channel 2 is moved in a way that the mouth piece 3 with the inlet opening 2*a* is passed via the guide roll 7 or the like, leaving the tail T, released from the suction channel 2, to be supported by the guide roll 7. The tail can thus be released gradually in the machine direction approximately onto the future running path of the paper web.

In an embodiment where the suction channel 2 is moved at least partly supported by separate transfer rolls 5, such as pulleys or the like, outside the path of the web W, it is possible to bend, as shown in FIG. 2, the suction channel 2 at its mouth piece 3 end towards the centre so that the mouth piece 3 can, during the transfer of the suction channel 2, be guided to pass e.g. via the guide roll 7 or the like and/or later precisely for example into a rope nip, i.e. rope gap 11, formed by threading ropes 8 or the like, most of the suction channel 2 being, however, simultaneously passed outside the final running path of the tail T. It is obvious that said guidance can also be implemented with a sufficient number of transfer rolls 5, wherein the suction channel 2, thanks to its flexibility, follows accurately the path determined by the transfer rolls 5 without entering e.g. between cylinders.

After bringing the tail T with said measures to run sufficiently well in the paper machine section, the actual threading of the web is conducted by separating from the web W running down from the cylinder 1, by cutting with a cutting blade 6 or the like, as a continuous extension to the tail T, a strip which is wider that the tail T and which is gradually widened further to guide a full-width web W following the tail T onto the portion.

FIGS. 5 to 9 illustrate well the wide area of application of the threading device according to the invention, in side views. In the figures, the suction channel in the initial situation is illustrated with broken lines, the path of the tail released by the suction channel is indicated with the letter T, and the path of the full-width web after threading is indicated with the letter W.

Figure 5:
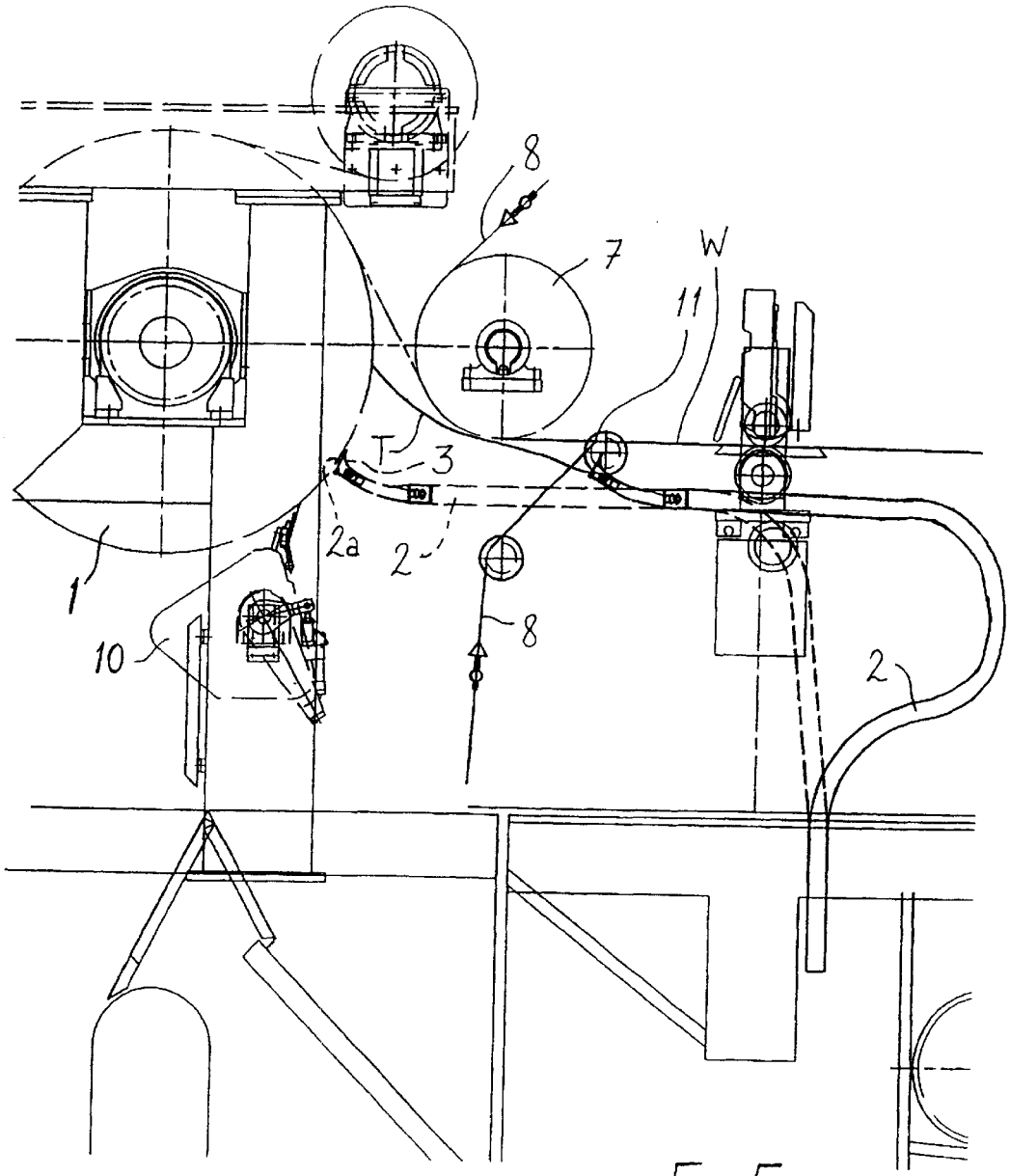
FIGS. 5 to 9 show different applications of the invention for threading the tail on portions of different lengths in the paper machine.

FIG. 5 shows how the tail T is moved from the vicinity of the drying cylinder 1 to a fixed rope nip 11 formed by threading ropes 8, wherein the distance of transfer, i.e. the distance passed by the inlet opening of the suction channel 2, is relatively short. The terminal end of the suction channel 2 is brought underneath the floor level of the paper machine, where the suction device 9 shown in FIGS. 1 and 3 can also be provided. FIG. 5 illustrates how, for enabling the transfer, the suction channel 2 can be looped in the machine direction in the direction of transfer of the suction channel.

Figure 6:
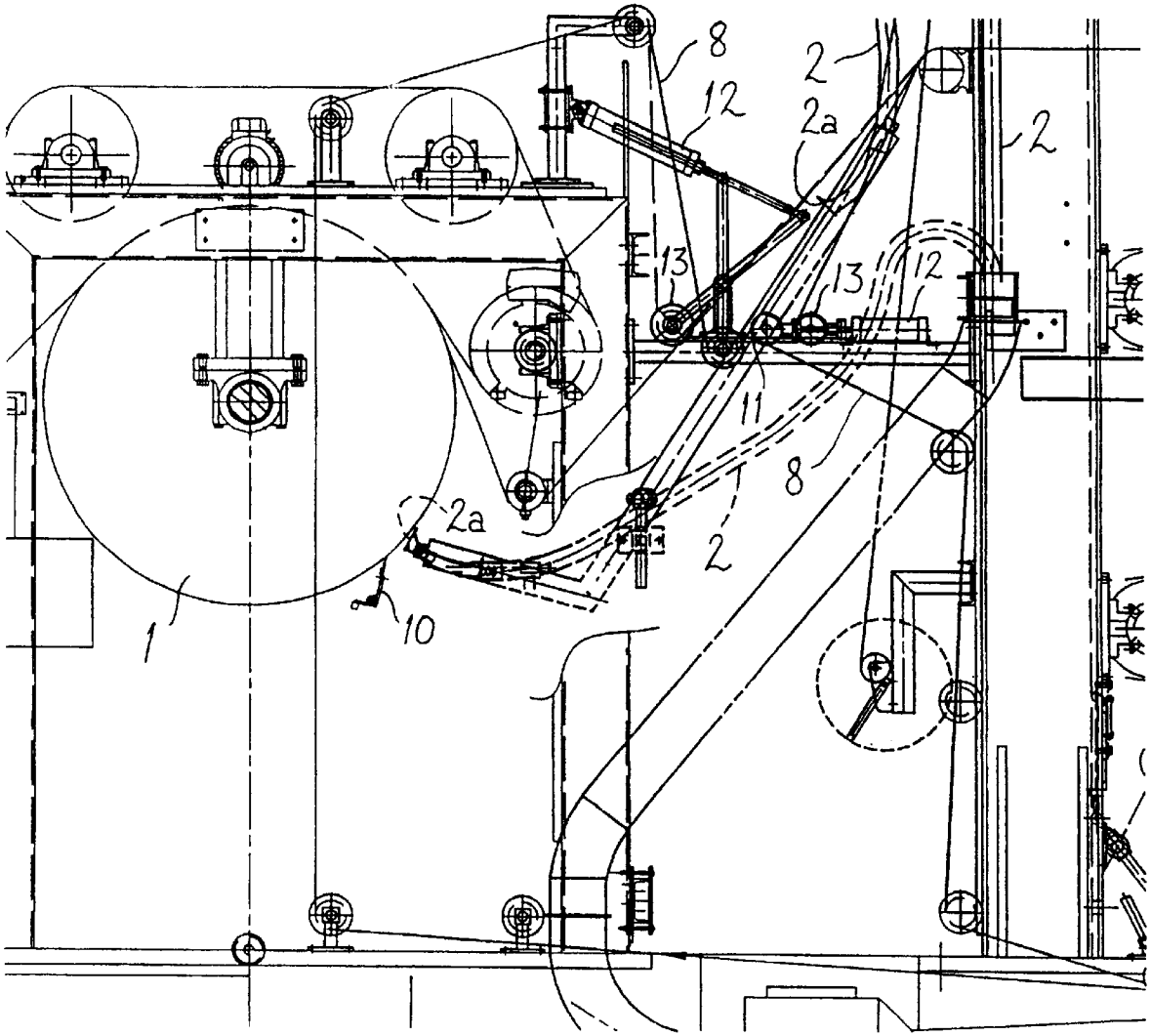

FIG. 6, in turn, illustrates the threading from the vicinity of the drying cylinder 1 to the rope nip 11 to be closed by means of rope pulleys 13 moved by actuators 12. Because the threading ropes 8 run slantingly upwards after the rope nip, the direction of transfer of the suction channel 2 is also upwards, and it can thus be lifted to make a loop to accomplish the transfer. The suction end of the suction channel 2 is placed underneath the floor level as in FIG. 5.

Figure 7:
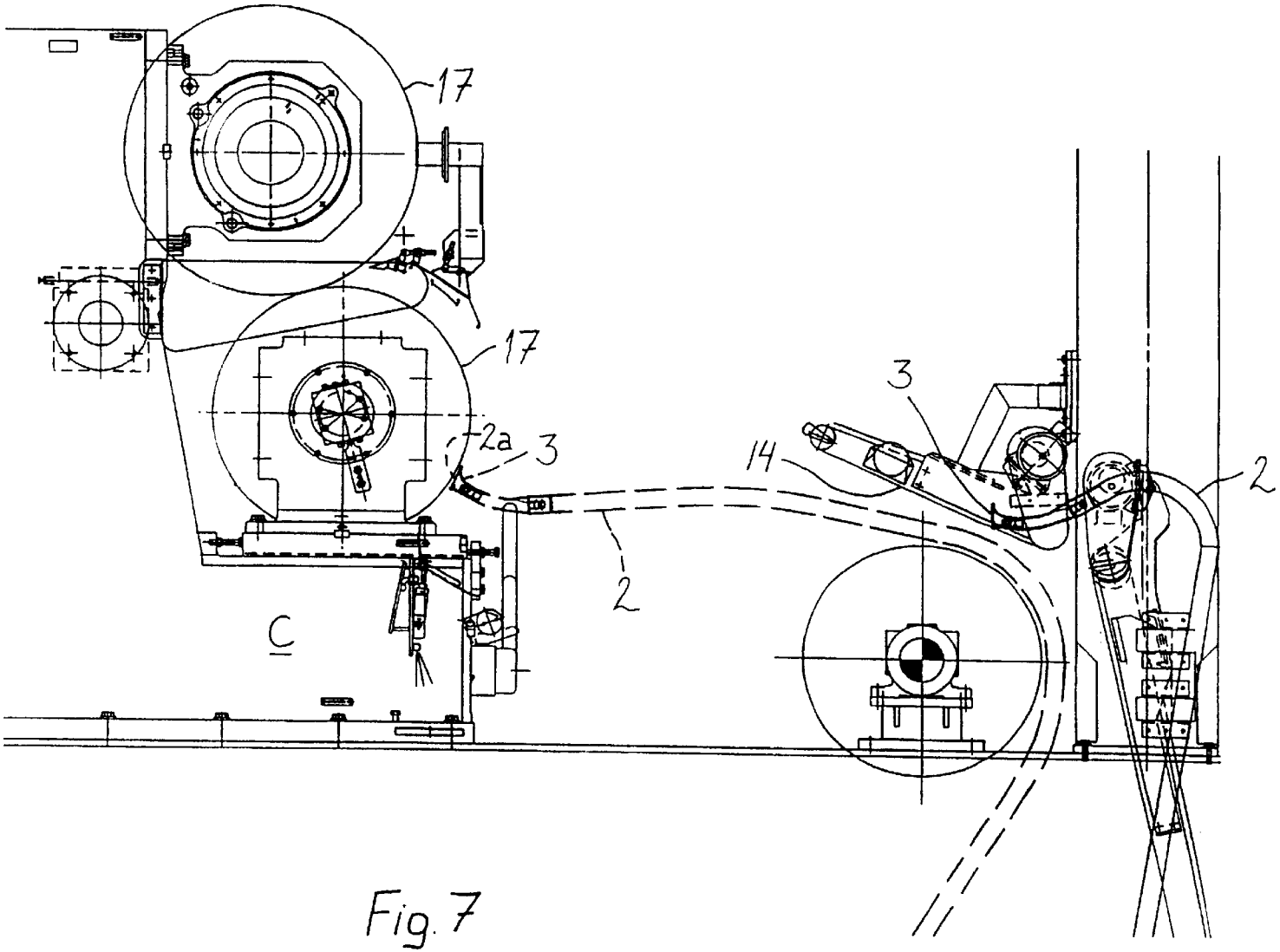

FIG. 7 illustrates the threading from the last pair of rolls in the calender section C, after the calender nip from the surface of the lower roll 17 to the suction belt 14.

FIGS. 1–7 show typically the threading of the tail from one machine section to the mechanical threading devices of the next section by means of a suction channel. However, the suction channel can also be used to implement the whole threading from the first section to the web-processing cylinders or rolls in the next section, or even through this next section. The suction channel 2 or at least its inlet opening can in this case pass through one or several open roll nips that are to be closed later for the processing of the web.

Figure 8:
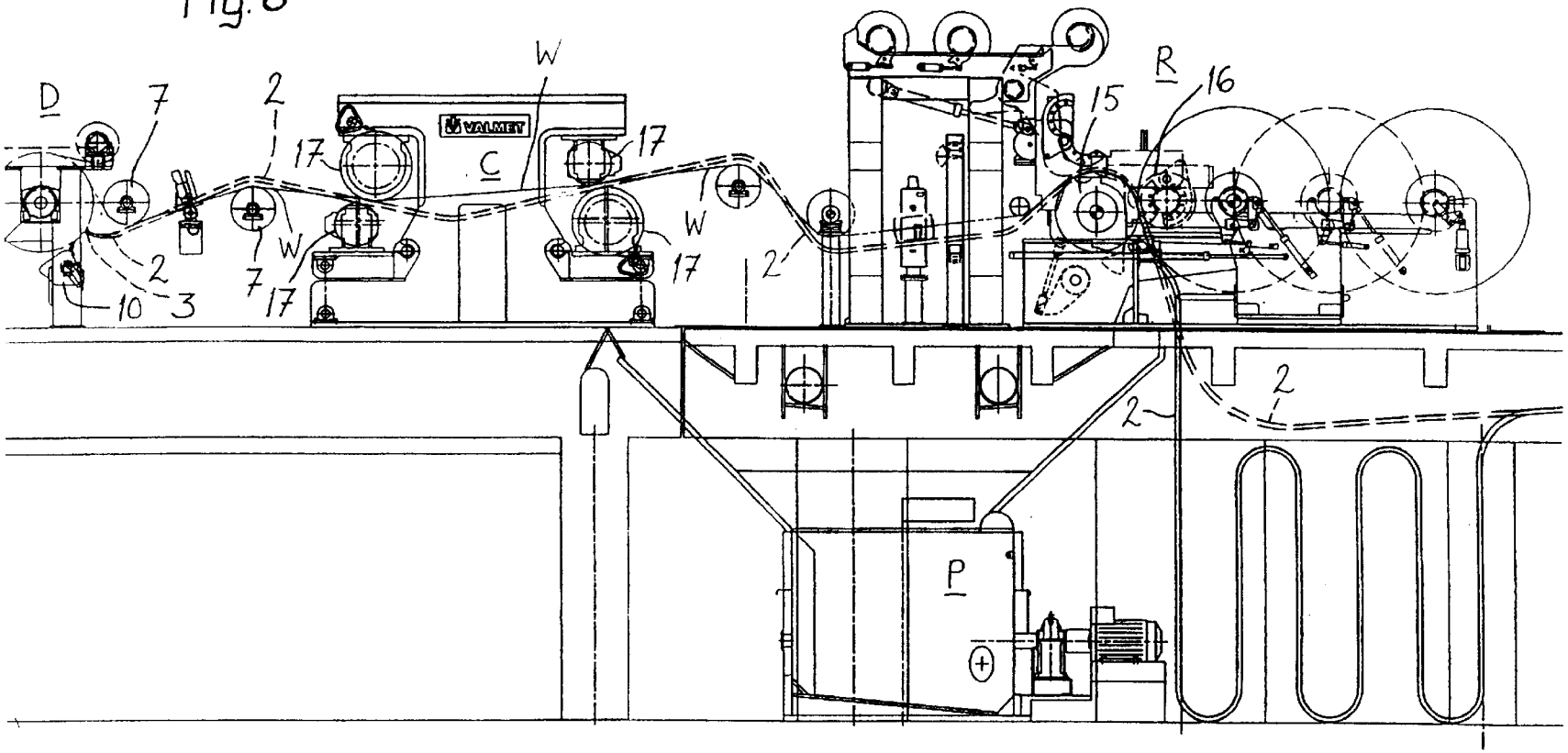

FIG. 8 illustrates the threading all the way from the drying cylinder 1 through the calender section C to the reeling cylinder 15 of the reel-up R, in this case through a soft-calender of two nips. The channel can be moved through successively situated open roll nips. In the figure, the channel 2 is moved through the roll interspaces of the calender rolls 17, i.e. through two successive pairs of calender rolls.

Figure 9:
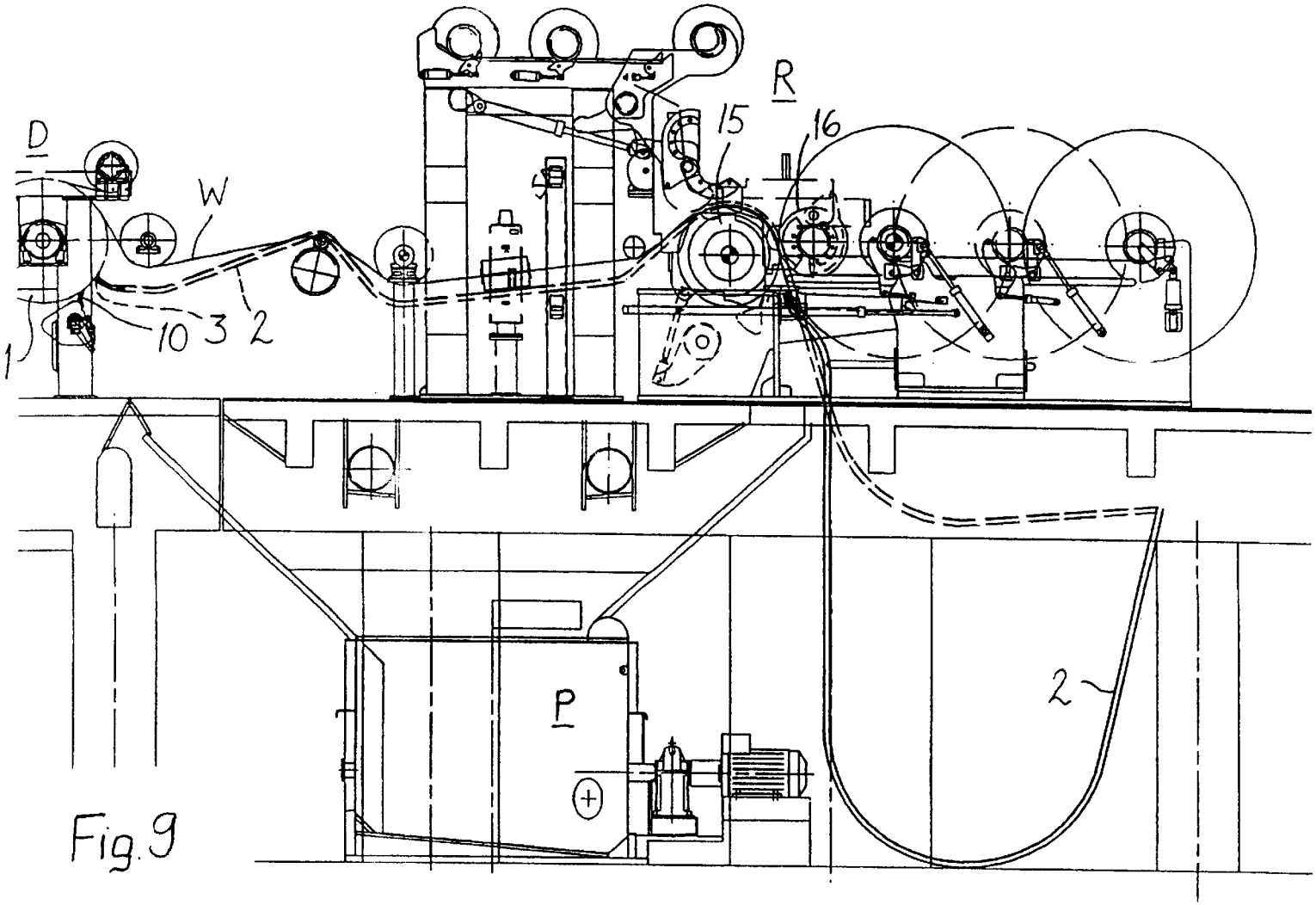

FIG. 9 illustrates the threading from a cylinder to a reel-up R via a coating station, such as a surface sizing unit. On the reel-up, the suction channel 2 can be moved between a reel spool 16 placed in the threading position and a reeling cylinder 15, and also this nip can be closed after the tail T is released in said location. The tail T can also be brought from a closer location up to the reel-up, if this is appropriate, for example from the calender section C, wherein the point of transfer to the suction channel 2 can initially be, e.g. as shown in FIG. 7, close to the second roll 17 in the pair of rolls of the calender.

Particularly in FIGS. 8 and 9, it is shown how it is possible in these long threading portions to collect the suction channel in a loop underneath the floor level at the height of the pulper P, e.g. to fold it in successive folds. As shown in the figures, the threading apparatus according to the invention is applicable to threading in a controlled manner even on a very long portion in the machine direction of the paper machine.

Figure 10:
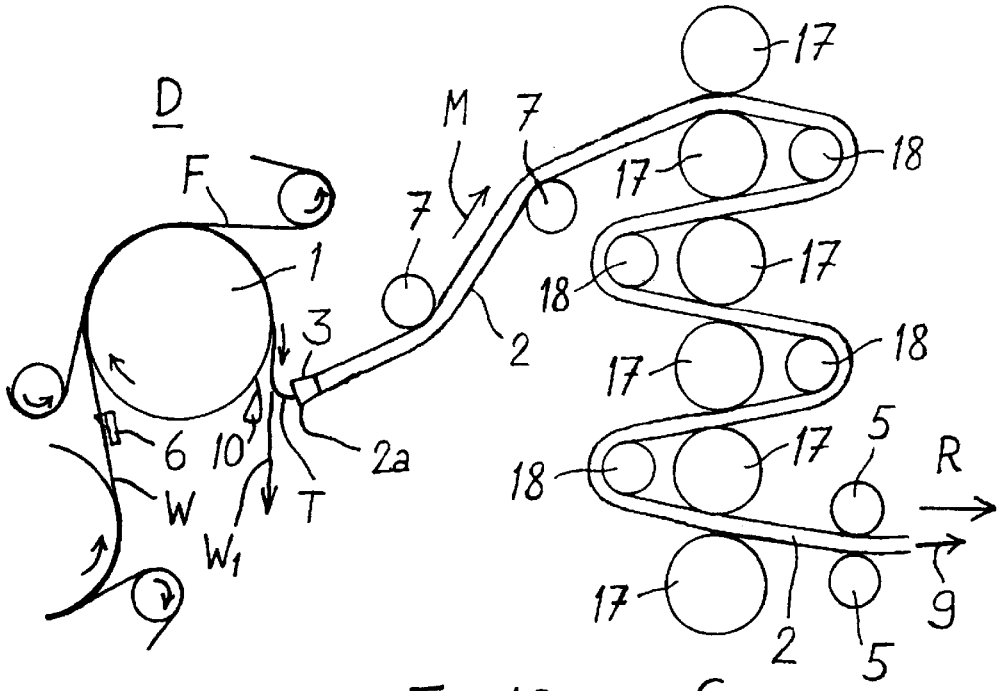
FIGS. 10 to 12 show an application of the invention in threading the tail through the calender section at different stages of operation.

FIG. 10 shows the calender section C. The calender is an on-machine calender for calendering, according to principles known as such, the paper web which comes from the drying section, by guiding it along a tortuous path through nips between calender rolls 17 placed on top of each other.

The geometry of the path of the paper web, followed at first by the tail to be led through the calender, is the following: The paper web is first led to the top end of the stack of calender rolls, into the nip between the two uppermost rolls 17. Between two successive nips, which are at opposite sides of the same calender roll 17, the paper web is led through a take-out leader roll 18 located beside said roll 17. FIG. 10 shows a calender structure comprising six calender rolls 17, five nips and, accordingly, four take-out leader rolls 18, but it is obvious that the invention is applicable for use in any calender with a similar path geometry, irrespective of the number of calender rolls/nips/take-out leader rolls. Neither does the surface structure of the calender rolls 17 have any significance for the invention, but they can be made of materials generally known in the field.

After the last nip at the bottom end of the stack of calender rolls, the paper web runs further towards the reel-up (arrow R).

Furthermore, FIG. 10 shows that portion of the path of the paper web before the calender section C which begins at the end of the machine section processing the web before the calender, in this case at the end of the drying section D. From the last drying cylinder 1 on the top row of a two-row drying section D, the paper web is led in a free run, guided by guide rolls 7, in between the two uppermost calender rolls 17 in the calender section C.

FIG. 10 shows the situation of starting the threading. A flexible suction channel 2 is placed to follow the path geometry described above, starting from the vicinity of the last drying cylinder 1 in the drying section D, extending through the guide rolls 7 to the calender section C, and further zigzagging through roll interspaces of the calender rolls 17 in the calender section and guided by the take-out leader rolls 18 on both sides of the calender stack, i.e. following the future run of the full-width paper web. After the stack of calender rolls, the suction channel 2 is led through two auxiliary rolls 5, and at its end, the suction channel 2 is connected to a suction device 9, which is schematically indicated with an arrow. The suction channel 2 is placed at a suitable position in the width direction of the stack of calender rolls, preferably at one edge at the point where one edge of the full-width paper web will run.

The distance of the initial end of the suction channel 2, i.e. the inlet opening 2*a*, from the last drying cylinder 1 of the drying section D in the running direction of the web is smaller than the distance thereof to the first roll interspace in the stack of calender rolls, and the inlet opening 2*a* can be quite close to the drying cylinder.

It is shown in the figure how an edge strip, i.e. tail T, having a width of ca. 15–50 cm is separated from the paper web W by a suitable cutting method, e.g. by a diagonal cutter 6 positioned close to one edge of the web. The tail T is led together with the rest of the web to the last drying cylinder 1. After the tail and the rest of the web have run on the mantle surface of the cylinder 1 and have been supported on part of their path by the continuous support fabric F of the upper cylinder row, the tail T is led to the inlet opening 2*a* of the suction channel 2 opening towards the cylinder 1, e.g. by using suitable prior-known air jets, which deflect the tail from the downwards directed running path and guide the tail into the tube. The rest of the web $W_1$ continues its run downwards and is guided to the pulper.

Thanks to the suction connected at its terminal end, the suction channel 2 can take up the tail T effectively.

Inside the suction channel 2, the tail T can become accumulated, e.g. into a wave-like tortuous shape, wherein its linear speed in the channel is slowed down. The tail can also be wider than the channel, wherein it is wrinkled into a cord-like shape within the channel. Especially in this case, for facilitating the insertion of the tail T, the beginning of the suction channel 2 terminating in the inlet opening 2*a* is designed as shown in FIGS. 1 to 9, i.e. as a trumpet-mouthed or funnel-shaped suction mouth piece 3 expanding from the dimensions of the rest of the tube towards the direction of entry of the tail; in other words, the inlet opening 2*a* has a wider area than the cross section of the inner part of the channel 2.

The suction channel 2 is kept in the position of FIG. 10 preferably as long as the tail T runs within the tube all the way through the stack of calender rolls in a tortuous manner according to the path geometry. After this, the inlet opening 2*a* of the suction channel 2 can be transferred in the running direction of the tail T (the transfer movement is indicated with an arrow M). The tube sets the running path of the tail free and the tail T running therealong comes gradually into contact with the means determining the running path of the web. The suction is maintained all the time during the transfer of the inlet opening 2*a* forward, so that the suction channel 2 can receive the tail T coming at a high speed from the drying section D and also can guide the tail T to run along the above-described route, originally covered by the suction channel 2, as the inlet opening 2*a* moves on. The roll interspaces between the calender rolls 17 are open to such an extent that the suction channel 2 fits between their mantle surfaces when the inlet opening 2*a* is transferred in the machine direction.

During the transfer, the suction channel 2 can run in roll interspaces in the stack of calender rolls so that it is in contact with both of the rolls 17. Outside the roll interspaces, the suction channel 2 runs, guided by the take-out leader rolls 18, in contact with their mantle surfaces on a certain sector. One possibility to transfer the suction channel 2 is to rotate at least some of the rolls 17 and 18 in the calender section at a suitable speed.

Figure 11:
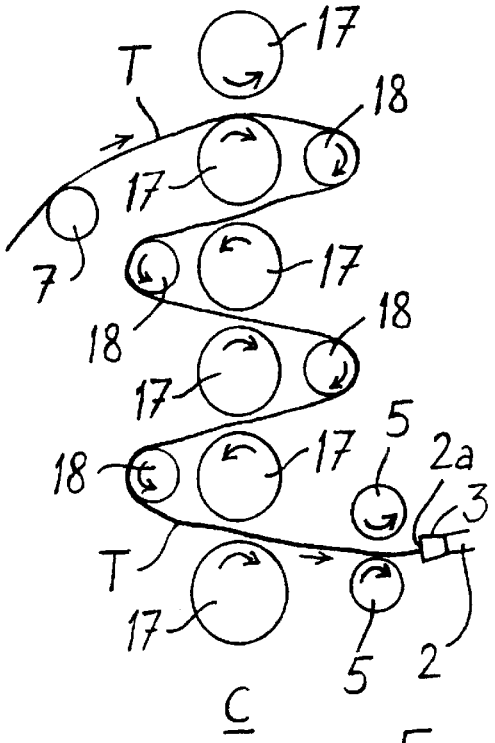
Figure 12:
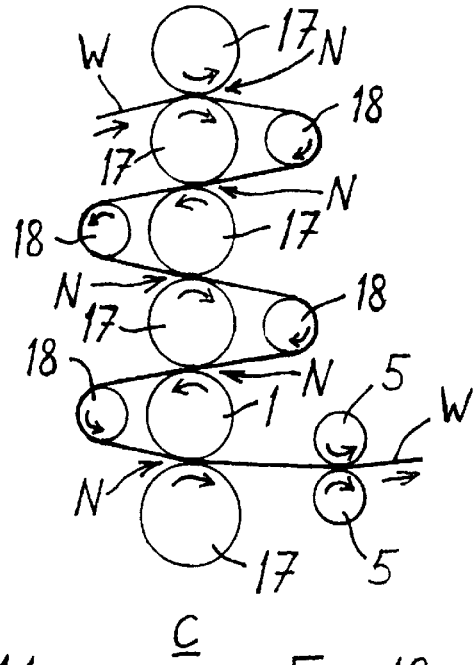

FIG. 11 shows the situation at the end of threading, when the inlet opening 2*a* is in a position after the stack of calender rolls, or to put it more precisely, transferred behind the auxiliary rolls 5. The tail T runs further, drawn by the suction in the suction channel 2, from the drying section D to the calender section C, through the stack of calender rolls and between the auxiliary rolls 5 in the calender section. At least one of the auxiliary rolls 5 is driven, and by closing the interspace between the rolls, the tail T can be retained in the auxiliary nip between the rolls, whereby by rotating the rolls, the tail T can now be drawn mechanically along the above-mentioned path and the path of the tail can be simultaneously stabilized on this route. In this situation, calender rolls 17 equipped with separate drives can be brought to rotation and accelerated to the running speed. If the calender rolls were already slowly rotated to transfer the suction channel 2, they can be accelerated to a higher rotational speed towards the running speed after they have been passed by the suction tube. The paper web W is subsequently spread to the full web width by a diagonal cutter 6, after which the full-width paper web runs through the whole calender section C into the auxiliary nip of the auxiliary rolls 5. The next step is to close the roll interspaces between the calender rolls 17 rotated at full speed by separate drives, whereby nips N are formed between the calender rolls 17 as illustrated in FIG. 12. The closing of the nips can be accomplished in an optimal order in view of the run of the paper web W.

The transfer of the inlet opening 2*a* of the suction channel 2 along the future running path of the paper web can be implemented for example so that the whole channel 2 is drawn in a way that its length is not changed, e.g. with the help of the rotational movement of the rolls 17, 18. Thus, it must be possible to collect the tube at a suitable location behind the calender section C. Furthermore, there can be guides on the running path of the suction channel 2 to guide its transfer and to ensure that it leaves the tail T in the correct position. The calender rolls 17 and the take-out leader rolls 18 of the calender section C and the stiffness of the suction tube in the transverse direction can be sufficient to guide the suction channel 2. In addition or as an alternative to the rolls 17, 18 of the calender section, the suction channel 2 can be drawn by another suitable tractive mechanism located after the calender section C and in connection with the terminal end of the channel 2, for example by means of friction wheels. There can also be friction wheels at suitable intervals on the whole route of the suction tube.

Furthermore, it is possible that the channel is accumulated in its longitudinal direction, wherein it will not take too much space behind the calender section C during the transfer, but it becomes gradually shorter. To implement this, the suction channel 2 can have a bellows-shaped structure, or it can consist of telescopically connected flexible portions which at least partly become inserted one inside the other during the transfer. In this case, the suction channel can be transferred with a transport device built at its beginning by the side of the running path of the web, and e.g. attached to the suction mouth piece. Also in this case, there can be support points and drive points along the length of the suction channel to guide and transfer the suction channel. Furthermore, the suction channel 2 can be folded into a suitable place, e.g. underneath the floor level.

After the threading, the suction channel 2 and the guides possibly guiding its transfer can be moved off the running path of the paper web W. Upon starting a new threading, the nips between the calender rolls are opened, possible guides are placed on the running path of the suction channel 2, and the suction channel 2 is placed in the position shown in FIG. 10 and connected to the suction.

It is also obvious that the method can be used in connection with other types of machine calenders than that shown in FIGS. 10–12. It can be used in vertical calender roll stacks which have not take-out leader rolls. Thus, the flexible tube can follow the mantle surfaces of the calender rolls all the way through the stack of rolls.

Also in the embodiment of FIGS. 10–12, part of the mouth piece 3 of the suction channel 2, such as a sharpened edge of the mouth piece, can constitute a cutting means for cutting the tail T, or the mouth piece can be equipped with a separate cutting blade.

The suction channel 2 is made of a suitable material, such as rubber or plastic, which secures its flexibility in the vertical plane extending the machine direction. The resulting closed hose-like structure can have such a cross-section that it accommodates well the width of the tail T, e.g. in a way that its dimension in the cross-machine direction is greater than its dimension in the height direction, i.e. suitably flat. It can have e.g. a rectangular cross section. Thanks to these dimensions, it can be made flexible, i.e. it is easily bent in the direction perpendicular to the greatest dimension (width), but it has a considerably greater flexural stiffness in its width direction, which keeps it better in the correct position in the cross-machine direction. Thus, it also has a suitable flexibility in runs of the paper web required by the path geometry. If the outer surface of the suction channel is of a resilient material (e.g. rubber-like materials), it will also have a sufficient friction with the calender rolls 17, and the calender rolls can be utilized in the transfer of the tube.

The suction effective in the suction channel 2 should be so strong that it is capable of taking up the tail T at a normal running speed of the paper machine. Such a suction can be produced by connecting the suction tube with the suction system of the paper machine. By known methods, it is possible to couple the rear end of the tube to a suction device 9 with such a suction connection which is as flexible as possible and is capable of adapting to the movements of the suction channel 2 during the transfer.

The invention is not limited solely to the embodiments presented in the above description, but it can be modified within the scope of the inventive idea disclosed in the claims. The threading can be accomplished by transferring the suction channel also in other portions of the paper machine than those described above. Similarly, the invention is suitable for use in threading also in other machines conveying and processing a continuous paper web than actual paper making paper machines, such as paper finishing machines, for example separate coating machines.

Similarly, the term paper web in the above description indicates all such materials, made of fibrous stock in a paper or board machine and being in form of a continuous web, in whose threading the invention can be applied, irrespective of the raw material fibre or grammage.

What is claimed is:

1. A threading device for conveying a tail separated from a full width web in a running direction of the tail along a portion of a paper machine or a paper finishing device, characterized in that the threading device comprises:

a suction channel having a vacuum for gripping the tail and extending in the running direction of the tail;

means for transferring said channel along said portion of said paper machine or paper finishing device, in the running direction of the tail.

2. A threading device according to claim 1, wherein said device further comprises means for cutting the tail.

3. A threading device according to claim 2, wherein said means for cutting the tail is coupled to a mouth piece in said suction channel.

4. A threading device according to claim 1, wherein said means for cutting the tail comprises a movable cutting blade.

5. A threading device according to claim 1, wherein said suction channel includes a mouth piece for facilitating the entry of an end of said tail into said suction channel.

6. A threading device according to claim 5, wherein said mouth piece has a one of a funnel shaped and trumpet like construction.

7. A threading device according to claim 1, wherein said means for transferring said channel comprises at least one guide roll.

8. A threading device according to claim 1, wherein said transfer means and said suction channel are adapted for transferring said tail from a drying section to a calender section.

9. A threading device according to claim 1, wherein said transfer means and said suction channel are adapted for transferring said tail through a calender section.

10. A threading device according to claim 1, wherein said suction channel is arranged through roll interspaces between a plurality of calender rolls in a calender section.

11. A threading device according to claim 10, further comprising a transfer mechanism arranged transfer an inlet opening of the suction channel in a running direction of the tail, to guide the tail into the said roll interspaces and onto a running path determined by said calender rolls.

12. A threading device according to claim 10, wherein said calender rolls are arranged in a calender roll stack.

13. A threading device according to claim 10, further comprising a pair of auxiliary rolls arranged after said calender rolls in a direction of travel of the paper web, at least one of said auxiliary rolls being rotatable to direct said suction channel through an interspace between said auxiliary rolls and wherein said auxiliary rolls are adapted to selectively pressed together to thereby press said tail between said auxiliary rolls.

14. A threading device according to claim 1, wherein said suction channel and said means for transferring said channel are structured and arranged to convey said tail forward in a running direction of said paper machine starting from a last calender nip in a calender section of said paper machine.

15. A threading device according to claim 1, wherein said suction channel and said means for transferring said channel are structured and arranged to convey said tail to a reel up of said paper machine.

16. A threading device according to claim 1, wherein said suction channel has a substantially flat cross section.

17. A threading device according to claim 1, wherein said suction channel is constructed to be compressible in a longitudinal direction.

18. A method for threading a tail of a web before threading a full width web along a portion of a paper machine or paper finishing device comprising the steps of:

generating a vacuum in a suction channel;

positioning an inlet opening of said suction channel in proximity to said tail;

transferring said tail into said suction channel through said inlet opening;

passing said tail through said suction channel;

guiding said suction channel along a selected portion of said paper machine or paper finishing device such that the inlet opening moves along a path through said selected portion; and releasing said tail from said suction channel through said inlet opening to said path for attachment to a selected portion of said paper machine.

19. A method according to claim 18, further comprising the step of guiding said tail released from said suction channel to pass over at least one guide roll.

20. A method according to claim 18, wherein said tail is transferred into said suction channel at a drying section of said paper machine and said tail is released at a calender section of said paper machine.

21. A method according to claim 18, wherein said guiding step includes guiding said suction channel through a calender section of said paper machine and said releasing step comprises releasing said tail into said calender section.

22. A method according to claim 18, wherein said guiding step comprises guiding said suction channel through a calender section of said paper machine and passing said tail through said suction channel to thereby guide said tail through said calender section.

23. A method according to claim 22, wherein said suction channel is guided between interspaces defined between rolls in said calender section.

24. A method according to claim 22, wherein said guiding step comprises guiding said suction channel through a plurality of roll interspaces defined between a plurality of calender rolls arranged in a stack.

25. A method according to claim 20, further comprising the steps of arranging an inlet opening of said suction channel in the vicinity of the last means for treating the surface of a web in a web treating section located before said calender section, and transferring said suction channel from said last means to a position after a lost one of said calender rolls in said calender section.

26. A method according to claim 20, further comprising the step of guiding said suction channel through auxiliary rolls arrange after a plurality of calender rolls in said calender section.

27. A method according to claim 18, wherein said guiding step comprises guiding said suction channel from a last calender nip in a calender section of the paper machine.

28. A method according to claim 18, wherein said suction channel is guided to a reel up in said paper machine and said tail is released at said reel up.

29. A method according to claim 18, wherein said suction channel is transferred by means of a tractive mechanism.

30. A method according to claim 18, wherein said suction channel is collected together in its longitudinal direction.

31. A method according to claim 18, further comprising the step of collecting the suction channel in a loop.

* * * * *

UNITED STATES PATENT AND TRADEMARK OFFICE

CERTIFICATE OF CORRECTION

PATENT NO. : 6,413,374 B1
DATED : July 2, 2002
INVENTOR(S) : Laurikaninen, Mauri et al.

It is certified that error appears in the above-identified patent and that said Letters Patent is hereby corrected as shown below:

Title page,
Item [87], PCT Publications Date, should be set forth as -- May 27, 1999 --.

Signed and Sealed this

Tenth Day of December, 2002

JAMES E. ROGAN
*Director of the United States Patent and Trademark Office*